United States Patent [19]

Kitson

[11] Patent Number: 4,648,482

[45] Date of Patent: Mar. 10, 1987

[54] LADDER ANCHOR

[76] Inventor: Michael J. Kitson, 6, Waters Green Court, Brockenhurst, Hants., SO4 7SQ, United Kingdom

[21] Appl. No.: 791,834

[22] Filed: Oct. 28, 1985

[51] Int. Cl.[4] ..... E06C 7/42

[52] U.S. Cl. ..... 182/108; 182/230

[58] Field of Search ..... 182/107, 108, 230, 111, 182/129, 200

[56] References Cited

U.S. PATENT DOCUMENTS

| | | | |
|---|---|---|---|
| 2,273,124 | 2/1942 | McDaniels | 182/108 |
| 3,432,003 | 3/1969 | La Pierre | 182/107 |
| 3,743,051 | 7/1973 | Cramer | 182/106 |
| 4,023,647 | 5/1977 | Confer | 182/108 |

*Primary Examiner*—Reinaldo P. Machado

*Attorney, Agent, or Firm*—Silverman, Cass, Singer & Winburn, Ltd.

[57] ABSTRACT

The present invention relates to a ladder anchor for stabilizing a ladder while in use.

The ladder anchor comprises a hollow member having at least a wedge-shaped front portion provided with a closable orifice for filling the member with ballast or discharging ballast therefrom, the member having a ground engaging surface and a top surface, the top surface having therein at least one recess for receiving one or each of the longitudinal struts of a ladder and providing a foot receiving surface between the recess or recesses and the base of the member.

Preferably, the member can be filled with water as the ballast.

10 Claims, 2 Drawing Figures

LADDER ANCHOR

The present invention relates to a ladder anchor for stabilising a ladder while in use.

Ladders are available in one or more sections, each of which comprises a pair of longitudinal struts of considerable length, generally at least 3 meters, held in spaced apart parallel relationship by a plurality of much shorter cross-struts, which are generally about 0.3 meters long. If a number of sections are used, they are generally arranged telescopically so that the length of the ladder can be adjusted.

In view of their high ratios of length to width, ladders when placed against, for instance, a wall can be very easily overbalanced sideways by a person on the ladder leaning over too far to one side or the other, in an attempt to reach a location remote from the top of the ladder. A large number of domestic and industrial accidents have occurred due to this.

It has therefore been proposed to provide a device which will stabilise a ladder during use. In one approach to this, the ladder is fixedly located in a shoe which is pivotally connected to a ground engaging member. Examples of such devices are shown in GB-A-0 141 199, GB-A-0 201 468, GB-A-0 260 403, GB-A-0 977 624, GB-A-1 013 250, GB-A-1 154 440, and GB-A-1 367 489. These devices are multicomponent devices which need to be adjusted to enable the ladder to be used. Also they are not readily removable from the ladder and are difficult to transport.

An alternative approach which is more simple is to provide a wedge for location beneath the end of each longitudinal strut to provide a flat surface for engagement with the ground and another flat surface for supporting the end of the longitudinal strut. Examples of such devices are shown in GB-A-0 197 220 and GB-A-0 128 449. These devices do not greatly increase the stability of ladders in use in respect of sideways movement, and only marginally increase their stability with respect to slipping.

Another problem with the use of ladders is that they are often used on surfaces which are uneven, yielding and/or slippery. This adversely affects the stability of the ladder. In the above mentioned patents there are a number of proposals for increasing stability with respect to uneven, yielding and/or slippery surfaces. However, these generally involve additional parts for or adjustments to the device.

Uneven, yielding and/or slippery surfaces can also present difficulties for the ladder user, in that they make it difficult and sometimes dangerous to step onto or off the ladder, especially when carrying a load in one hand. No solution to this problem has so far been proposed.

It is an object of the present invention to provide a ladder anchor which, at least in part, overcomes the problems referred to above.

According to the present invention there is provided a ladder anchor comprising a hollow member provided with a closable orifice for filling the member with ballast or discharging ballast therefrom, the member having a ground engaging surface and a top surface, the top surface having therein a recess for receiving the or each of longitudinal struts of a ladder and providing a foot receiving surface between the recess or recesses and the base of the member.

The hollow member may be wedge shaped, being generally triangular in cross-section, having two relatively long sides and one relatively short side. The long sides of the wedge will provide the top and ground engaging surfaces and the short side will provide the base.

The angle between the two long sides will be in the region of 20° so that it is approximately equal to the angle between the ladder in use and the vertical.

The member may be truncated at its apex between the two longer sides, but it should not be truncated to such an extent as to reduce significantly the length of the ground engaging surface.

Alternatively, the hollow member may have a wedge shaped front portion and a generally rectangular rear portion. The bottoms of the wedge shaped portion and the rectangular portion may be coextensive and provide the ground engaging surface. The top of the rear portion will provide the foot receiving surface.

It will be appreciated that the top and ground engaging surfaces and base of the member will be generally rectangular, although other shapes may be adopted as desired by a manufacturer.

The closable orifice may be provided at any convenient location in the member. However, it is preferred that it is located at the apex of the wedge shaped member or the wedge shaped front portion adjacent in the junction of the apex and the ground engaging surface.

The orifice may be closable in any conventional manner. For instance it may be provided with a snap-fit or screw on cap. Alternatively, the orifice may be internally screw-threaded and may receive a complementarily-threaded plug.

Preferably, the ground engaging surface has on it a non-skid finish. This may be made integral with the member or may be attached, for instance by adhesive or welding, to the member.

In this latter case the non-skid finish may be provided by a corrugated or pimpled rubber sheet. However, preferably corrugations or pimples are formed on the ground engaging surface during manufacture of the member. Conveniently the corrugation or pimples are raked towards the base.

Advantageously, the foot receiving surface is also provided with a non-skid finish. This may also be provided in any of the ways referred to above.

The top surface may have in it only one recess in which both longitudinal struts of the ladder are received. However, preferably a recess is provided for each strut. Clearly the recesses will need to be spaced apart a sufficient distance to allow this. The longitudinal axis of the recess (if only one recess is used) or the axis between the two recesses (if two recesses are used) will lie generally parallel to the base of the member. Advantageously, the distance between the outside edges of the recess or the recesses is marginally greater than the distance between the outside edge of the longitudinal struts of the ladder.

Preferably, the inside of the member is reinforced, for instance by mouldings or strutting, in the region around the or each recess.

Preferably, the or each recess is so shaped that the longitudinal struts fit snugly therein so that in use the ladder cannot move to any great extent relative to the member.

Alternatively the member may be provided with a fixing device for holding the longitudinal struts in the or each recess. The device may comprise a bolt and wing nut, the bolt being passed through a bore in the member and complementary holes in the longitudinal struts.

Advantageously, the or each recess is located as far towards the apex of the member as possible.

Preferably, the member is provided with a handle to facilitate transport and filling and emptying thereof. Conveniently the handle is provided at the apex of the member, and advantageously it is formed integrally in the member. Conveniently, the handle is formed between two recesses for the ladder's legs, and the orifice is formed in the handle.

It is envisaged that in a preferred embodiment of the invention, the member will be made as a single moulding from a plastics material. In making such a moulding it will be possible to form a non-skid finish on the entire ground engaging surface and on the foot receiving surface and to form reinforcing mouldings around the or each recess. If necessary channels may also be formed in the reinforcing moulding to allow ballast to flow into all parts of the member.

When the ladder anchor of the present invention does not contain any ballast, it is envisaged that it will be light and easy to transport. To prepare it for use, the orifice is opened and the anchor is filled with ballast. Preferably, the ballast used is water, as this is readily available at sites where a ladder is likely to be used. However, any other form of ballast can be used. For instance, sand or other flowable minerals may be used in place or of in addition to water.

Once the anchor is full of ballast, it will be heavy and will therefore engage the ground firmly. The ladder is then located on the anchor with its longitudinal struts in the or each recess. If a securement device is used, the ladder is now secured to the anchor. Alternatively, the ladder is effectively connected to the anchor by the snug fit in the or each recess.

As the ladder is now effectively connected to the anchor, its centre of gravity is moved to a considerably lower point, and the effective size of its base has been increased. It will therefore be significantly more difficult to overbalance the ladder by sideways movement. Moreover, it will be much more easy to get into or off the ladder as the person using the ladder will be able to step onto or off the foot receiving surface rather than uneven, slippery or yielding ground. The ladder will also be more stably located on the ground due to the large area of the ground engaging surface, and also, where provided, due to its non-skid finish.

After the ladder has been used, the member can be emptied of its ballast and easily moved to the next site of operation or can be stored. In all of the stages of the use of the ladder anchor of the present invention, there is no need for any assembly of the member or adjustment of any parts of it, yet it provides a significant increase in the stability of the ladder during use.

It is envisaged that the ladder anchor of the present invention will find use use in both domestic and industrial applications.

One embodiment of a ladder anchor according to the present invention is now described, by way of example only, with reference to the accompanying drawings, in which.

Figure 1:
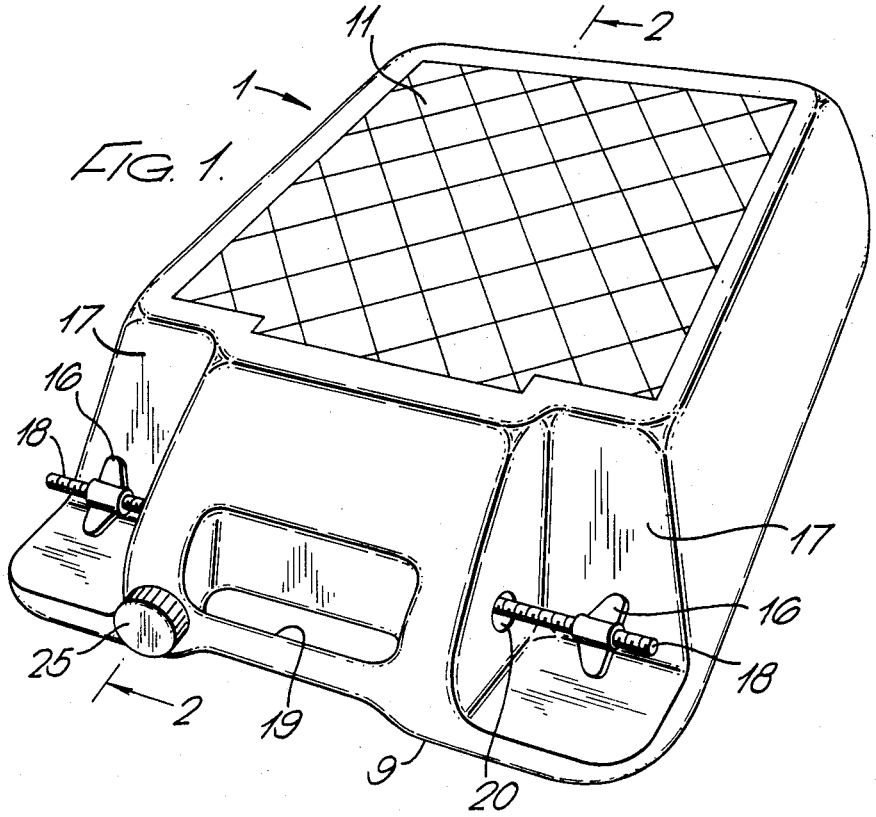
FIG. 1 shows a perspective view of the ladder anchor.
Figure 2:
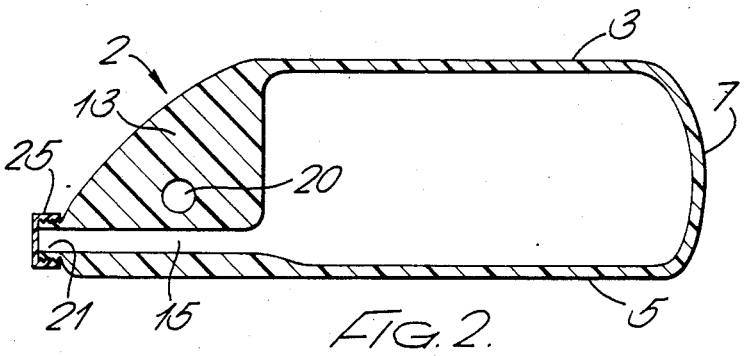
FIG. 2 is a sectional view of the ladder anchor along line 2—2 of FIG. 1.

Referring now to the drawings, there is shown the ladder anchor which comprises a moulded plastics member 1 having a front portion 2 in the shape of truncated wedge. The member has a top surface, 3, a ground engaging surface 5, a base 7 and a truncated end 9. A foot receiving portion 11 is provided on the top surface 3.

A reinforcing moulding 13 is formed transversely of the member and has a connecting channel 15 passing therethrough.

Two recesses 17 are formed in the moulding 13 in the front portion 2 of the member 1. The recesses are formed on either side of the member 1, and are spaced apart by a distance equal to the spacing of the longitudinal struts of a ladder. The recesses 17 are sized so as to receive the ends of the longitudinal struts of a ladder.

A transverse hole 20 is formed through the moulding 13 and receives therethrough a threaded bolt 18 which is adapted to receive wing nuts 16.

A hand grip 19 is formed in the middle of the apex of the front portion 2 of the member 1.

An orifice 21 is formed in the apex of the member 1. The orifice 21 is externally threaded and is adapted to receive a complementarily threaded cap 25 provided with knurling for enabling it to be manually screwed onto the orifice 21.

The ground engaging surface 5 and the foot receiving surface 11 are formed with a non-skid finish in the form of a pimpled surface. (Shown by cross hatching in FIG. 1).

This embodiment is designed for use with water as the ballast. However, sand or another mineral could be used as the ballast, so long as the size of the channel 15 is large enough to allow easy flow of the ballast therethrough.

The ladder anchor shown in the Figures is used in the manner described above. It can thus be seen that the only operations to be carried out to put the ladder anchor to use are to fill it with water, to insert the ends of the longitudinal struts into the recesses 17, to insert the bolt 18 through holes formed in the ends of the struts and the hole 20 in the moulding 13, and to screw on the wing nuts 16. Even though the ladder anchor is easy to use it has been shown that its use significantly improves the stability of a ladder on any sort of ground and with respect to sideways movement. Moreover in the embodiment shown in the drawings, there is also improved stability with respect to the tipping of the ladder backwards or forwards due to the secure anchoring of the struts in the recesses 17. The use of the ladder anchor also facilitates getting on or off the ladder as the person using the ladder can step onto or off it from the stable skid resistant foot receiving area.

It can thus be seen that the present invention provides a simple to use device which significantly improves safety in using ladders.

I claim:

1. A ladder anchor comprising a hollow member having:

a wedge shaped front portion which is generally triangular in cross section and has a bottom and a sloping front face;

a rear portion which is generally rectangular in cross section and has a bottom and a top;

a closable orifice for filling the member with ballast or discharging ballast therefrom; and at least one recess in the sloping front face of the front portion for receiving the longitudinal struts of a ladder;

the bottom of the front portion and the bottom of the rear portion being coextensive and providing a ground engaging surface, and the top of the rear portion providing a foot receiving surface.

2. The ladder anchor of claim 1 wherein the closable orifice is located in the apex of the wedge shaped front portion adjacent the ground engaging surface.

3. The ladder anchor of claim 1, wherein the ground engaging surface and the foot receiving surface are provided with a non-skid finish.

4. The ladder anchor of claim 1, wherein a recess is provided for each strut.

5. The ladder anchor of claim 1, wherein the inside of the front portion of the hollow member is reinforced in the region around the at least one recess.

6. The ladder anchor of claim 1, further comprising fixing means for holding the longitudinal struts in the at least one recess.

7. The ladder anchor of claim 6, wherein said fixing means comprises a bolt and wing nut, said member includes a bore and said struts include holes complementary with said bore, said bolt being passed through said bore and said complementary holes.

8. The ladder anchor of claim 1, wherein the hollow member is provided with a handle at its apex to facilitate transport and filling and emptying thereof.

9. The ladder anchor of claim 8, wherein the closable orifice is located in the handle.

10. The ladder anchor of claim 1, wherein the member is made as a single moulding from a plastics material.

* * * * *